US009472840B2

(12) United States Patent
Herbsommer et al.

(10) Patent No.: US 9,472,840 B2
(45) Date of Patent: Oct. 18, 2016

(54) DIELECTRIC WAVEGUIDE COMPRISED OF A CORE, A CLADDING SURROUNDING THE CORE AND CYLINDRICAL SHAPE CONDUCTIVE RINGS SURROUNDING THE CLADDING

(71) Applicant: Texas Instruments Incorporated, Dallas, TX (US)

(72) Inventors: Juan Alejandro Herbsommer, Allen, TX (US); Baher Haroun, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 11 days.

(21) Appl. No.: 14/285,616

(22) Filed: May 22, 2014

(65) Prior Publication Data

US 2014/0368301 A1 Dec. 18, 2014

Related U.S. Application Data

(60) Provisional application No. 61/834,213, filed on Jun. 12, 2013.

(51) Int. Cl.
*H01P 3/16* (2006.01)
*H01P 3/12* (2006.01)

(52) U.S. Cl.
CPC ..... *H01P 3/16* (2013.01); *H01P 3/122* (2013.01)

(58) Field of Classification Search
CPC ..... H01P 3/16; H01P 3/18
USPC ..... 333/239
See application file for complete search history.

(56) References Cited

U.S. PATENT DOCUMENTS 3,703,690 A * 11/1972 Ravenscroft ..... H01P 3/16 333/240
4,323,867 A * 4/1982 Temes ..... H01P 3/06 138/110
4,785,268 A * 11/1988 Walter ..... H01P 9/00 333/157
5,889,449 A * 3/1999 Fiedziuszko ..... H01P 1/203 333/239

OTHER PUBLICATIONS

Gerd Schuppener, "Dielectric Waveguide with RJ45 Connector", U.S. Appl. No. 13/854,954, filed Apr. 1, 2013, pp. 1-81.

* cited by examiner

*Primary Examiner* — Benny Lee
(74) *Attorney, Agent, or Firm* — Lawrence J. Bassuk; Frank D. Cimino

(57) ABSTRACT

A dielectric waveguide (DWG) has a dielectric core member that has a length L and an oblong cross section. The core member has a first dielectric constant value. A dielectric cladding surrounds the dielectric core member; the cladding has a second dielectric constant value that is lower than the first dielectric constant. A conductive shield layer surrounds a portion of the dielectric cladding.

14 Claims, 11 Drawing Sheets

DIELECTRIC WAVEGUIDE COMPRISED OF A CORE, A CLADDING SURROUNDING THE CORE AND CYLINDRICAL SHAPE CONDUCTIVE RINGS SURROUNDING THE CLADDING

CLAIM OF PRIORITY UNDER 35 U.S.C. 119(e)

The present application claims priority to and incorporates by reference U.S. Provisional Application No. 61/834,213 filed Jun. 12, 2013, entitled "Isolation of Signals Travelling In Dielectric Waveguides."

FIELD OF THE INVENTION

This invention generally relates to dielectric wave guides for high frequency signals, and in particular to shielding of dielectric waveguides.

BACKGROUND OF THE INVENTION

In electromagnetic and communications engineering, the term waveguide may refer to any linear structure that conveys electromagnetic waves between its endpoints. The original and most common meaning is a hollow metal pipe used to carry radio waves. This type of waveguide is used as a transmission line for such purposes as connecting microwave transmitters and receivers to their antennas, in equipment such as microwave ovens, radar sets, satellite communications, and microwave radio links.

A dielectric waveguide employs a solid dielectric core rather than a hollow pipe. A dielectric is an electrical insulator that can be polarized by an applied electric field. When a dielectric is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field which reduces the overall field within the dielectric itself. If a dielectric is composed of weakly bonded molecules, those molecules not only become polarized, but also reorient so that their symmetry axis aligns to the field. While the term "insulator" implies low electrical conduction, "dielectric" is typically used to describe materials with a high polarizability; which is expressed by a number called the "dielectric constant ($\in k$)". The term "insulator" is generally used to indicate electrical obstruction while the term "dielectric" is used to indicate the energy storing capacity of the material by means of polarization.

The electromagnetic waves in a metal-pipe waveguide may be imagined as travelling down the guide in a zig-zag path, being repeatedly reflected between opposite walls of the guide. For the particular case of a rectangular waveguide, it is possible to base an exact analysis on this view. Propagation in a dielectric waveguide may be viewed in the same way, with the waves confined to the dielectric by total internal reflection at its surface.

BRIEF DESCRIPTION OF THE DRAWINGS

Particular embodiments in accordance with the invention will now be described, by way of example only, and with reference to the accompanying drawings.

Figure 1:
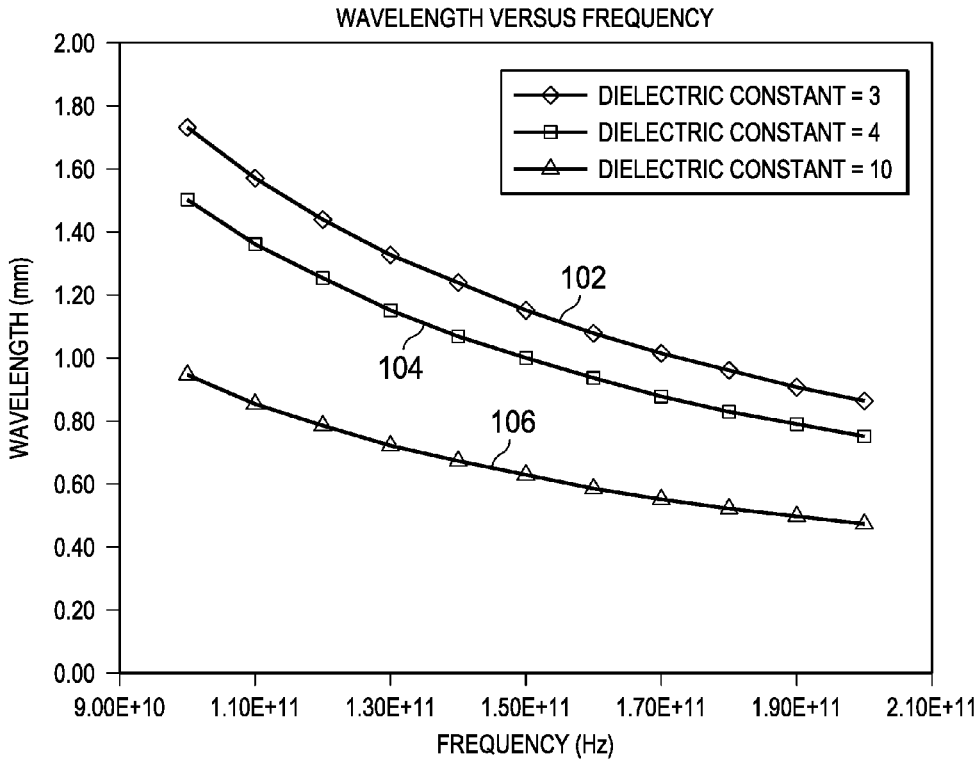
FIG. 1 is a plot of wavelength versus frequency through materials of various dielectric constants.

Other features of the present embodiments will be apparent from the accompanying drawings and from the detailed description that follows.

DETAILED DESCRIPTION OF EMBODIMENTS OF THE INVENTION

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

As frequencies in electronic components and systems increase, the wavelength decreases in a corresponding manner. For example, many computer processors now operate in the gigahertz realm. As operating frequencies increase to sub-terahertz frequencies, the wavelengths become short enough that signal lines that exceed a short distance may act as an antenna and signal radiation may occur. FIG. 1 is a plot of wavelength in mm versus frequency in Hz through materials of various dielectric constants. Plot line 102 represents material with dielectric constant of 3, plot line 104 represents material with dielectric constant of 4, and plot line 106 represents material with dielectric constant of 10. As illustrated by plot 102 which represents a material with a low dielectric constant of 3, such as a printed circuit board, a 100 GHz signal will have a wavelength of approximately 1.7 mm. Thus, a signal line that is only 1.7 mm in length may act as a full wave antenna and radiate a significant percentage of the signal energy.

Waves in open space propagate in all directions, as spherical waves. In this way they lose their power proportionally to the square of the distance; that is, at a distance R from the source, the power is the source power divided by $R^2$. A wave guide may be used to transport high frequency signals over relatively long distances. The waveguide confines the wave to propagation in one dimension, so that under ideal conditions the wave loses no power while propagating. Electromagnetic wave propagation along the axis of the waveguide is described by the wave equation, which is derived from Maxwell's equations, and where the wavelength depends upon the structure of the waveguide, and the material within it (air, plastic, vacuum, etc.), as well as on the frequency of the wave. Commonly-used waveguides are only of a few categories. The most common kind of waveguide is one that has a rectangular cross-section, one that is usually not square. It is common for the long side of this cross-section to be twice as long as its short side. These are useful for carrying electromagnetic waves that are horizontally or vertically polarized.

For the exceedingly small wavelengths encountered for sub-THz radio frequency (RF) signals, dielectric waveguides perform well and are much less expensive to fabricate than hollow metal waveguides. Furthermore, a metallic waveguide has a frequency cutoff determined by the size of the waveguide. Below the cutoff frequency there is no propagation of the electromagnetic field. Dielectric waveguides have a wider range of operation without a fixed cutoff point.

It has now been discovered that it may be beneficial to isolate a signal travelling through a dielectric waveguide from external influences. This external influence may be just simple handling or a finger touching the dielectric waveguide, for example. Testing has indicated that if not properly isolated, a simple touch of a finger to the exterior of a dielectric waveguide may cause a major degradation of the signal.

Figure 2:
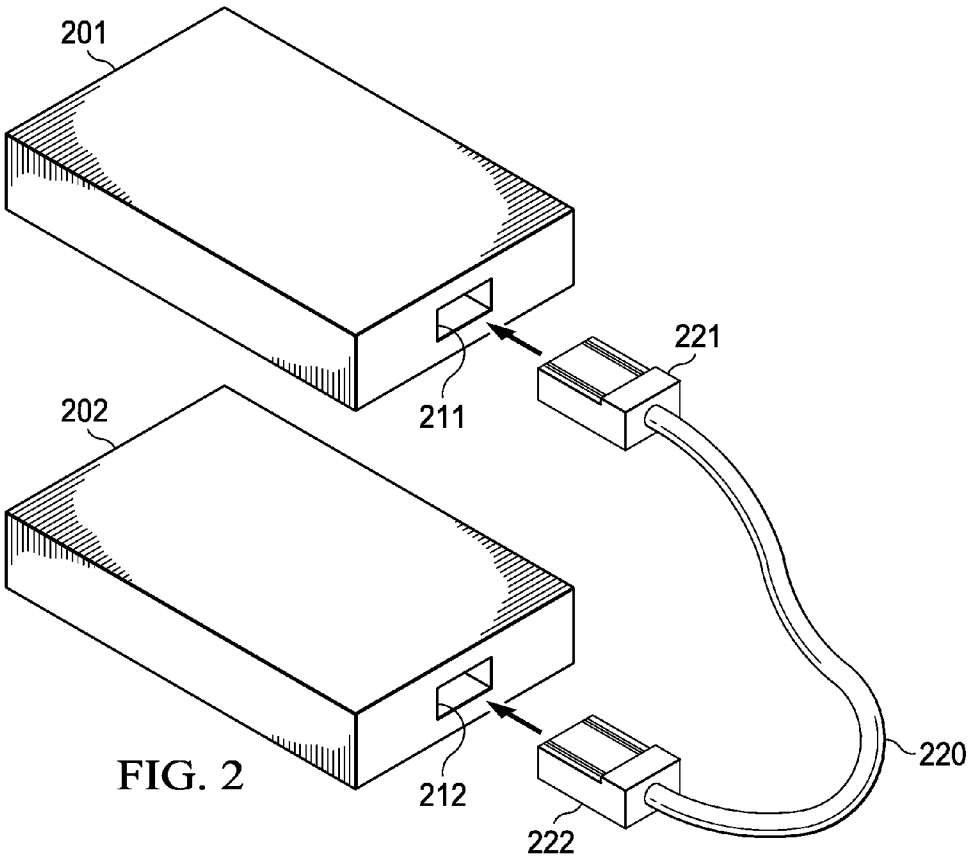
FIG. 2 is an illustration of two systems being interconnected with a dielectric waveguide (DWG)

FIG. 2 is an illustration of two systems 201, 202 being interconnected with a dielectric waveguide (DWG) 220. The two systems may be a computing device and a peripheral device or two computing devices that a user is connecting together for personal or business use, for example. The systems may be any form of computing device, such as, but not limited to: a rack mount, desk mount, or portable computer, a mobile user device such a notebook computer, a tablet computer, a smart phone, etc, for example. The systems may be any type of peripheral device such as: a media storage device such as rotating or solid state disk drive, a modem or other interface to a high speed network, etc, for example.

DWG 220 may be flexible or rigid DWG as will described in more detail below, for example. The DWG may be a combination cable as, such as an enhanced USB cable that includes a DWG, for example. The connection may use an RJ45 connector, for example. There may be a single DWG, or there may be multiple DWGs, depending on the requirements of the systems. Various examples of DWGs and terminating schemes for DWGs are described in more detail in U.S. patent application Ser. No. 13/854,954, filed Apr. 1, 2013, now U.S. Pat. No. 9,373,878, issued Jun. 21, 2016, entitled Dielectric Waveguide with RJ45 Connector that is incorporated by reference herein.

Connectors 221 and 222 may be inserted into respective matching receptacles 211, 212 by a user or system integrator. The connectors and receptacles may be RJ45 style connectors, or any other type of connector that provides alignment for DWG 220.

Each system 201, 202 may contain a PWB or other type substrate on which are mounted one or more integrated circuits that produce or receive a sub-terahertz signal that is coupled to a DWG that is then terminated in receptacles 211, 212. The manner of coupling between the IC and the DWG may be implemented using any of the techniques described in U.S. Pat. No. 9,373,878, for example.

In this manner, two or more electronic devices may be easily interconnected to provide sub-terahertz communication paths between the electronic devices by using the techniques described herein. As will now be described in more detail, a DWG may be shielded with a metallic layer, or other type of conductive coating, to protect signal transmission from possible interference when touching another object that may couple to the transmitted signal, such as a finger or hand, for example.

Figure 3:
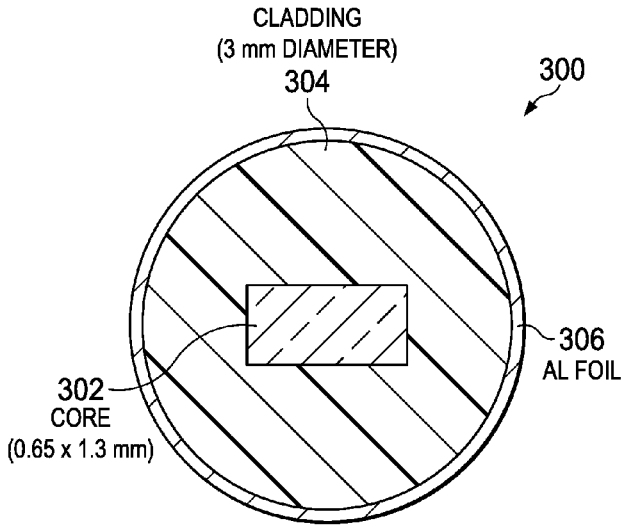
FIG. 3 is cross section of a DWG that is shielded.

FIG. 3 is cross section of a DWG 300 that is shielded with a layer 306 of aluminum (Al) foil. In order to provide isolation from external influences, a conductive coating such as layer 306 may be applied to the external surface of the dielectric waveguide. This layer could be a metallic foil made of aluminum, copper or any good conductivity material. This layer could be made using conductive paint or by various types of evaporation or sputtering methods, for example. The thickness of this metal layer should to be thicker than the skin depth thickness of the metal used in the frequency range of interest. For example, at 140 GHz the skin depth of metals with high conductivity (Cu, Al, Au, etc.) is less than 1 um; thus essentially any metal layer may serve as a good shield.

A flexible waveguide configuration may have a core member 302 made from flexible dielectric material with a high dielectric constant ($\in$k1) and be surrounded with a cladding 304 made from flexible dielectric material with a low dielectric constant, (Ek2). While theoretically, air could be used in place of the cladding, since air has a dielectric constant of approximately 1.0, any contact by humans, or other objects may introduce serious impedance mismatch effects that may result in signal loss or corruption. Therefore, typically free air does not provide a suitable cladding.

For sub-terahertz signals, such as in the range of 130-150 gigahertz, an oblong core dimension of approximately 0.65 mm×1.3 mm works well. As frequency increases, wave length decreases and the physical size of the dielectric core may also be reduced for higher frequency signals. In general, good performance may be obtained as long as the core size is selected to have a dimension that is in the range of approximately 0.3 to 3 times of the wavelength of a target signal that is to be transmitted through the DWG. The design of a DWG for a particular target signal frequency and wavelength may be adjusted to optimize attenuation and dispersion by selecting a size within this range, for example.

In general there is no golden rule about the dimensions of the DWG cross section or core dimensions. For a given set of materials, either multimode or mono-mode transmission may occur within a dielectric waveguide. This depends on the dimensions of the core. For example, using HDPE (high density polyethylene) for the core and Polypropylene for the cladding with a core dimension smaller than 0.45 mm×0.9 mm for a signal frequency of approximately 140-200 GHz will result in a mono-mode dielectric waveguide. Such a mono-mode DWG only has one mode of propagation but does not have a cutoff frequency. Such a mono-mode DWG has an important dispersion at lower frequencies. A mono-mode DWG is good for applications in which inter-mode transfer of energy is not wanted. Multimode transmission, on the other hand, may have many modes of signal propagation; however, each mode may have a different cutoff frequency.

While a rectangular cross section for core 302 is illustrated in this example, various oblong cross sections may be used, such as: rectangular, an oval, elliptical, a rectangle with rounded corners, etc., for example. In this example, an aspect ratio for the width of 1.3 mm to the height of 0.65 mm is two and produces good multimode operation of the DWG. However, in other embodiments the aspect ratio may be somewhat less than or somewhat greater than two, for example, and still produce good multimode operation.

In this example, cladding 304 has a circular cross section with a diameter of approximately 3 mm. Simulations have shown that the insertion loss produced by a DWG is less when the cross sectional shape of the cladding is different from the cross sectional shape of the core. Thus, in this example a core with a rectangular cross section is combined with a cladding having a circular cross section. Other embodiments may use other combinations of core and cladding cross sectional shapes to produce a low insertion loss.

In this example, the dielectric constant of the core material will typically be in the range of 3-12, while the dielectric constant of the cladding material will typically be in the range of 2.5-4.5.

DWG 300 may be fabricated using standard manufacturing materials and fabrication techniques, such as by using drawing, extrusion, or fusing processes, for example, which are all common-place to the manufacture of plastics.

Figure 4:
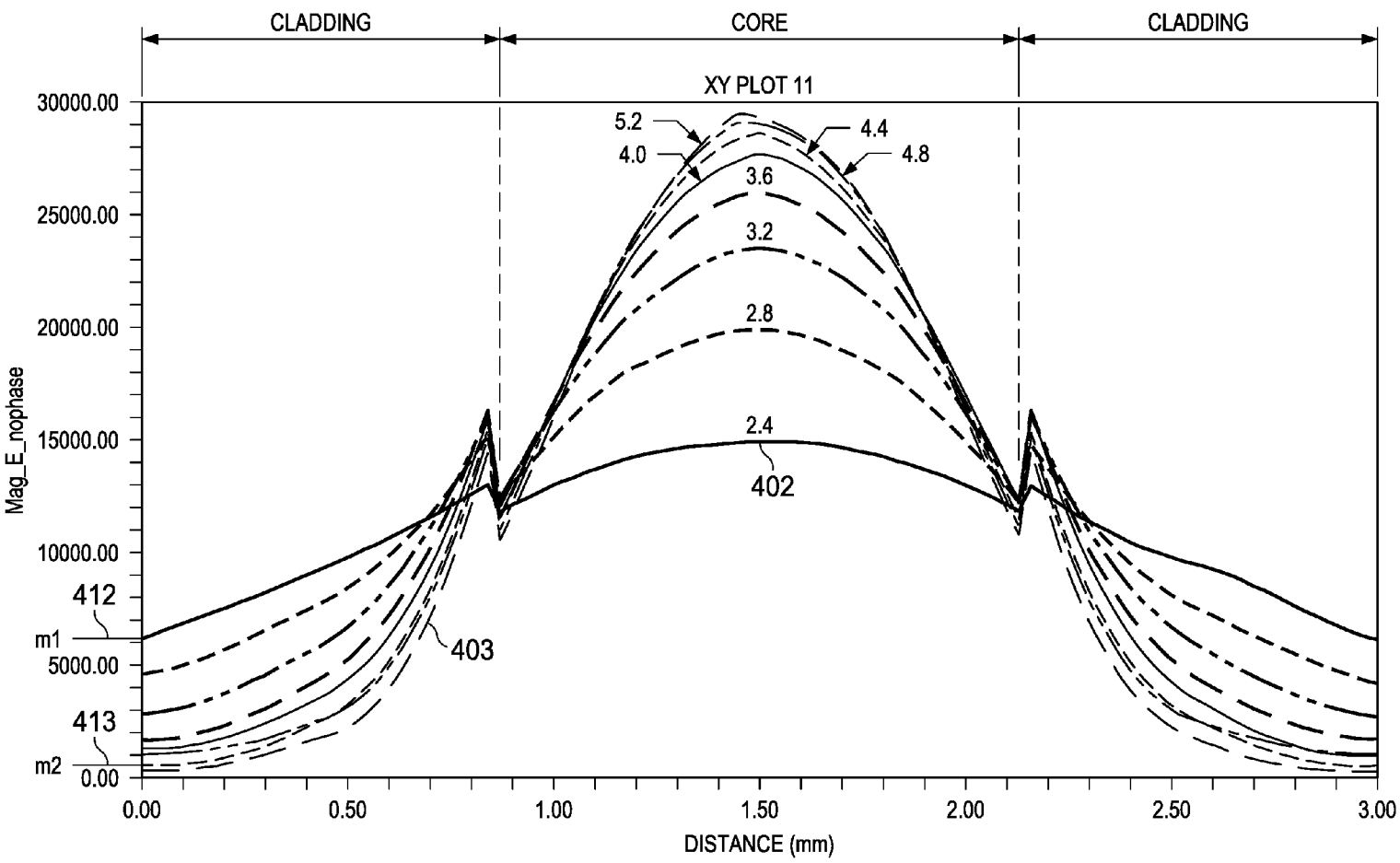
FIG. 4 is a plot illustrating field strength across a DWG with various ratios of dielectric constants between the core and cladding.

FIG. 4 is a plot of Mag E nophase versus Distance (mm) illustrating field strength across a set of DWGs with various ratios of dielectric constants between the core (XY PLOT 11) and cladding. As mentioned above, the dielectric constant of the core material will typically be in the range of 3-12, while the dielectric constant of the cladding material will typically be in the range of 2.5-4.5. The DWG represented by plot line 402 may have a core dielectric constant of 6 and a cladding dielectric constant of 2.5, for example, which provides a ratio of 2.4. Similarly, the DWG represented by plot line 403 may have a core dielectric constant of 12 and a cladding dielectric constant of 2.3, for example, which provides a ratio of 5.2. The other plot lines 2.8, 3.2, 3.6, 4.0, 4.4, and 4.8 represent other combinations of dielectric values that provide ratios of 2.8, 3.2, 3.6, 4.0, 4.4, and 4.8, for example.

As discussed above, Maxwell's equations may be used to determine that the field strength in the DWG drops off exponentially in the cladding region, as illustrated by the plots. With a low dielectric constant ratio, the field strength is more disbursed and is therefore higher at the boundary of the cladding, as indicated at point 412 for DWG 402. For a higher dielectric constant ratio, the field strength is more peaked in the center of the core and less disbursed and is therefore lower at the boundary of the cladding, as indicated at point 413 for DWG 403.

Since the electric field drops off exponentially, there will always be some amount of evanescent wave travelling on the outer surface of the DWG. When the amount of evanescent wave on the surface of the DWG is low enough, such as indicated at 413, then there may not be much of a problem with external objects coupling to the transmitted signal. However, when there is significant field strength at the edge of the cladding, there is more opportunity for coupling of the signal to an external object, such as a finger or hand that is touching the DWG. While human flesh is mainly water, it may also act as a dielectric with a higher dielectric constant value than air, which is 1.0. This may cause a finger or hand, for example, to cause a local disturbance in the field at the point of contact and in turn cause a reflection down the DWG that may seriously degrade the signal that is being transmitted through the DWG.

As can be deduced from the plots of FIG. 4, if the cladding is thick enough, then the evanescent wave may be reduced enough that coupling to an external object may not be a problem. However, a thick DWG may cost more, be more expensive, be less flexible, etc., for example.

Figure 5:
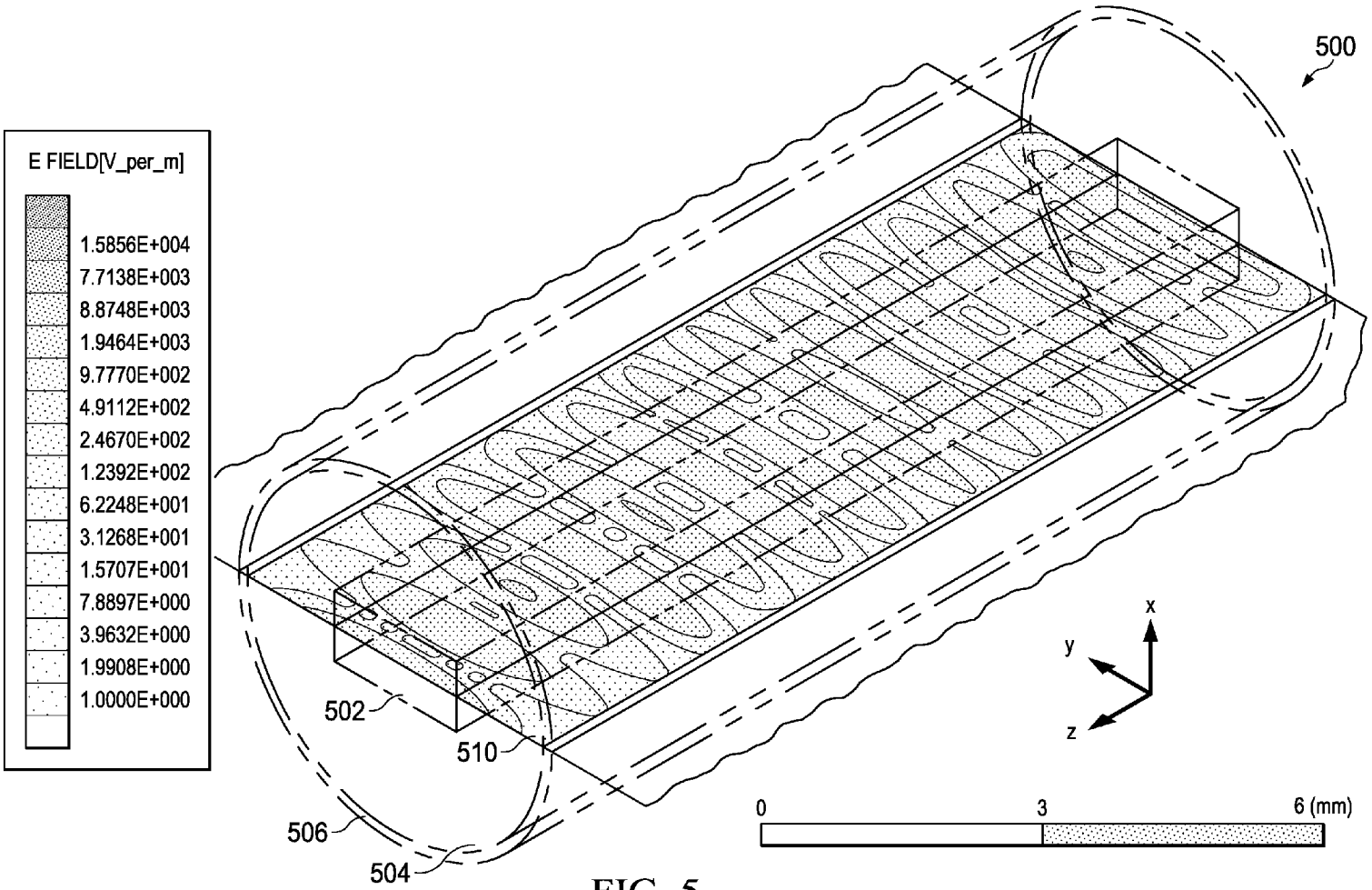
FIG. 5 is simulation illustrating a perfectly shielded DWG.

FIG. 5 is simulation plot illustrating a perfectly shielded DWG 500 in the X, Y, and Z directions with a length scale of from 0 to 6 mm. A field intensity scale presents values for E Field [V per in]. A signal traveling along core 502 and cladding 504 produces an electric field that is illustrated by simulated field 510. The field is cut off by conductive shield 506 on the outside of cladding 504, as illustrated in FIG. 5.

Figure 6:
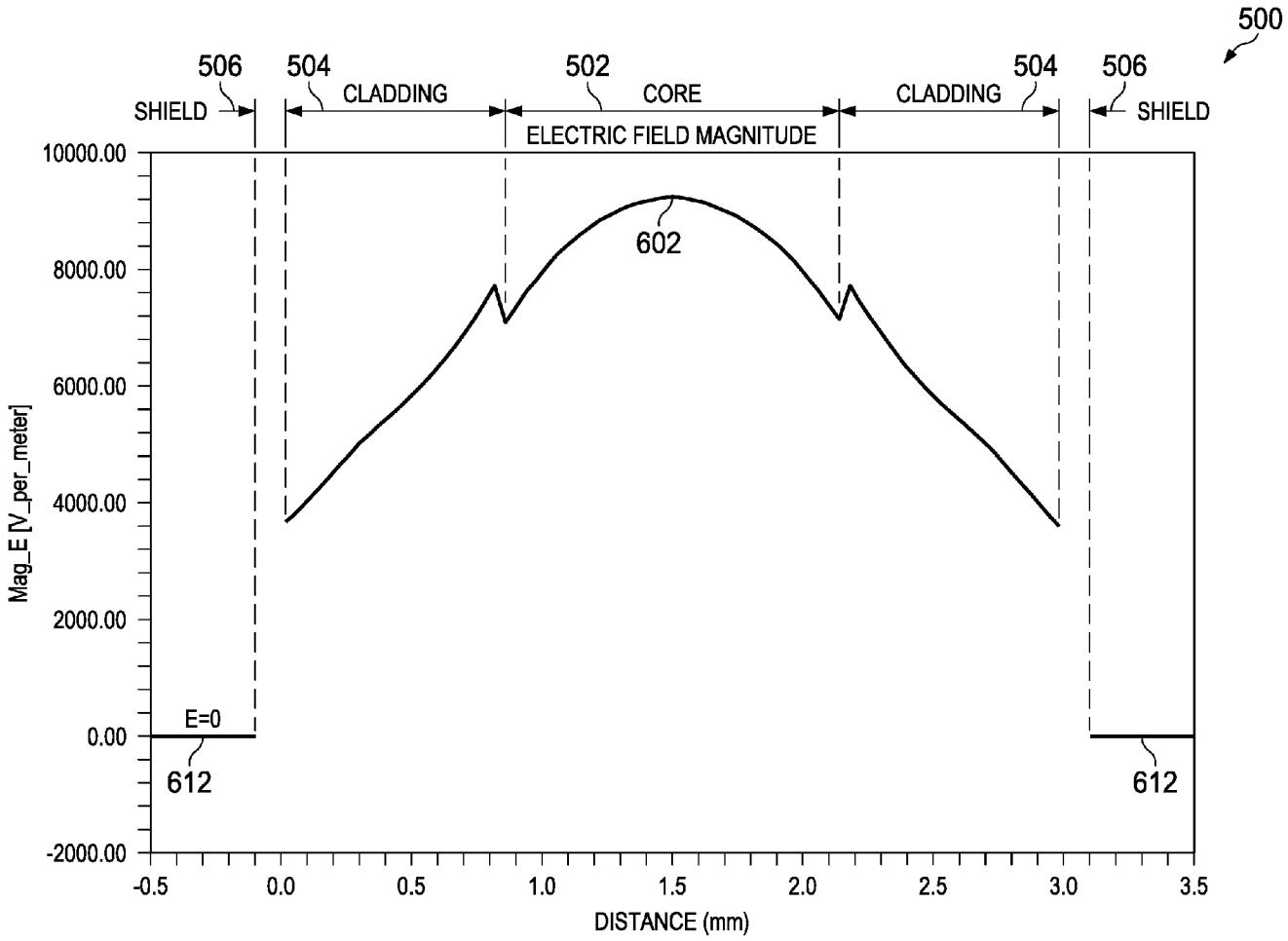
FIG. 6 is a plot illustrating field strength across the DWG of FIG. 5.

FIG. 6 is a plot of ELECTRIC FIELD MAGNITUDE, Mag E [V per meter] versus Distance (mm) illustrating field strength across DWG 500 of FIG. 5. Based on the dielectric constant ratio of the core region 502 and the cladding region 504, the field strength drop off exponentially in the cladding region 504, as described with regard to FIG. 4. In this example, the field strength 602 at the edge of the cladding is approximately 3600 V/meter. As discussed above, this is high enough that if DWG 500 is touched by a user's finger or hand a significant reflection of the transmitted signal may occur due to coupling of the field to the user's finger or hand. Shield 506 attenuates the field strength to approximately zero (E=0) outside the DWG, as indicated at 612.

Figure 7A:
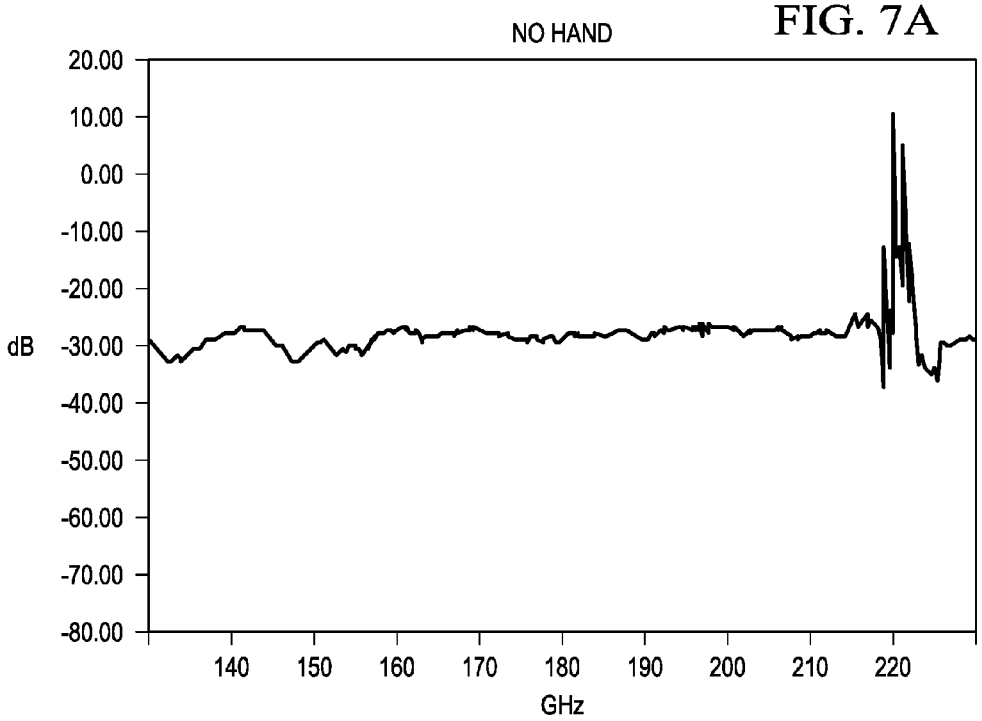
FIGS. 7A, 7B illustrate performance of a shielded DWG.
Figure 7B:
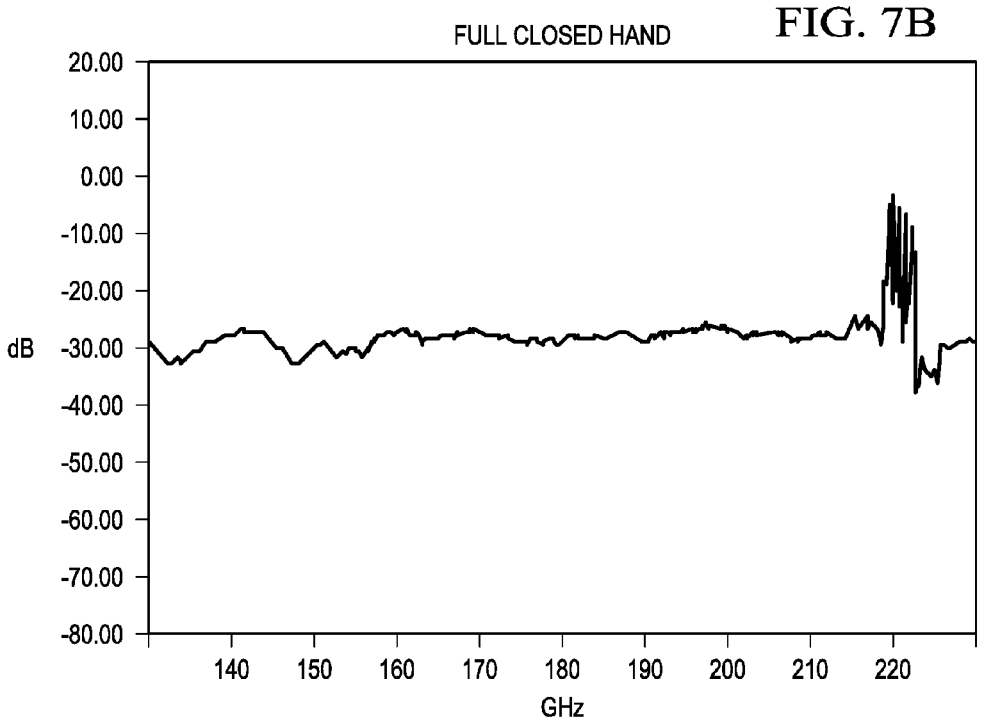

FIGS. 7A, 7B illustrate performance of shielded DWG 500. Since the field strength is essentially zero outside shield 506, the user may touch and handle DWG while it is transmitting a signal with no interfering effects. FIG. 7A is a plot illustrating insertion loss in dB versus frequency in GHz for a length of DWG 500 across a range of frequencies from approximately 140 GHz to 220 GHz during which the DWG is not being touched (i.e. No Hand). FIG. 7B is a plot illustrating loss in dB versus frequency in GHz for the same frequency sweep in which a user's hand is wrapped around (i.e. Full Closed Hand) DWG 500. Note, there is no significant difference in the insertion loss causes by the contact with user's hand.

Figure 8:
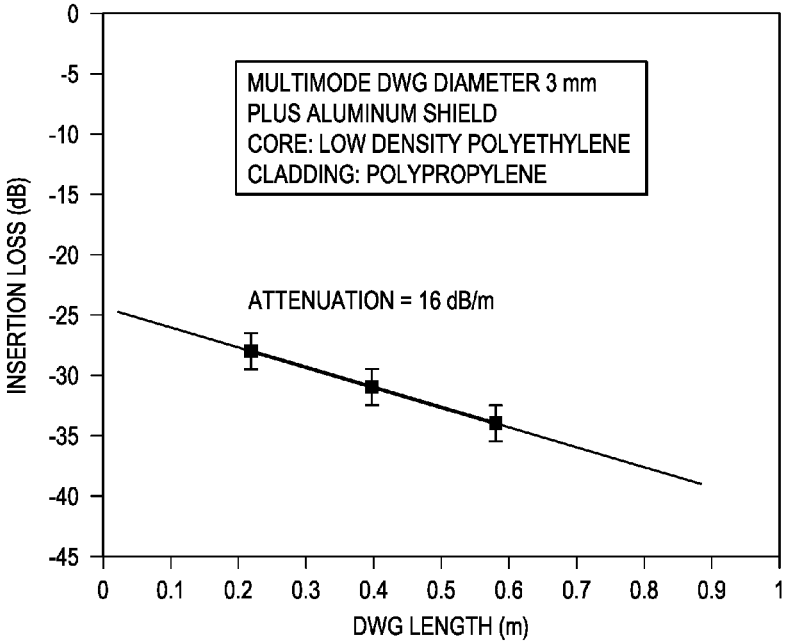
FIG. 8 is a plot illustrating insertion loss from a shielded DWG.

FIG. 8 is a plot of Insertion Loss (dB) versus DWG Length (m) illustrating insertion loss in dB from shielded DWG 500 for a multimode DWG diameter of 3 mm, an aluminum shield, a core of low density polyethylene, and cladding of polypropylene. The presence of a shield on the outer surface of the DWG attenuates whatever evanescent wave is present at that location. This in turn results in an insertion loss to the signal being transmitted along the DWG. In the example DWG 500 with an aluminum shield layer, an attenuation of approximately 16 dB/meter is observed. For a DWG in which the magnitude of the evanescent field on the surface is lower, the insertion loss caused by the shield may be lower.

Thus, adding a shield to a DWG may increase the insertion loss caused by the DWG, but it is generally better to have a known constant insertion loss than an unpredictable higher magnitude disturbance caused by touching or handling the DWG.

Figure 9:
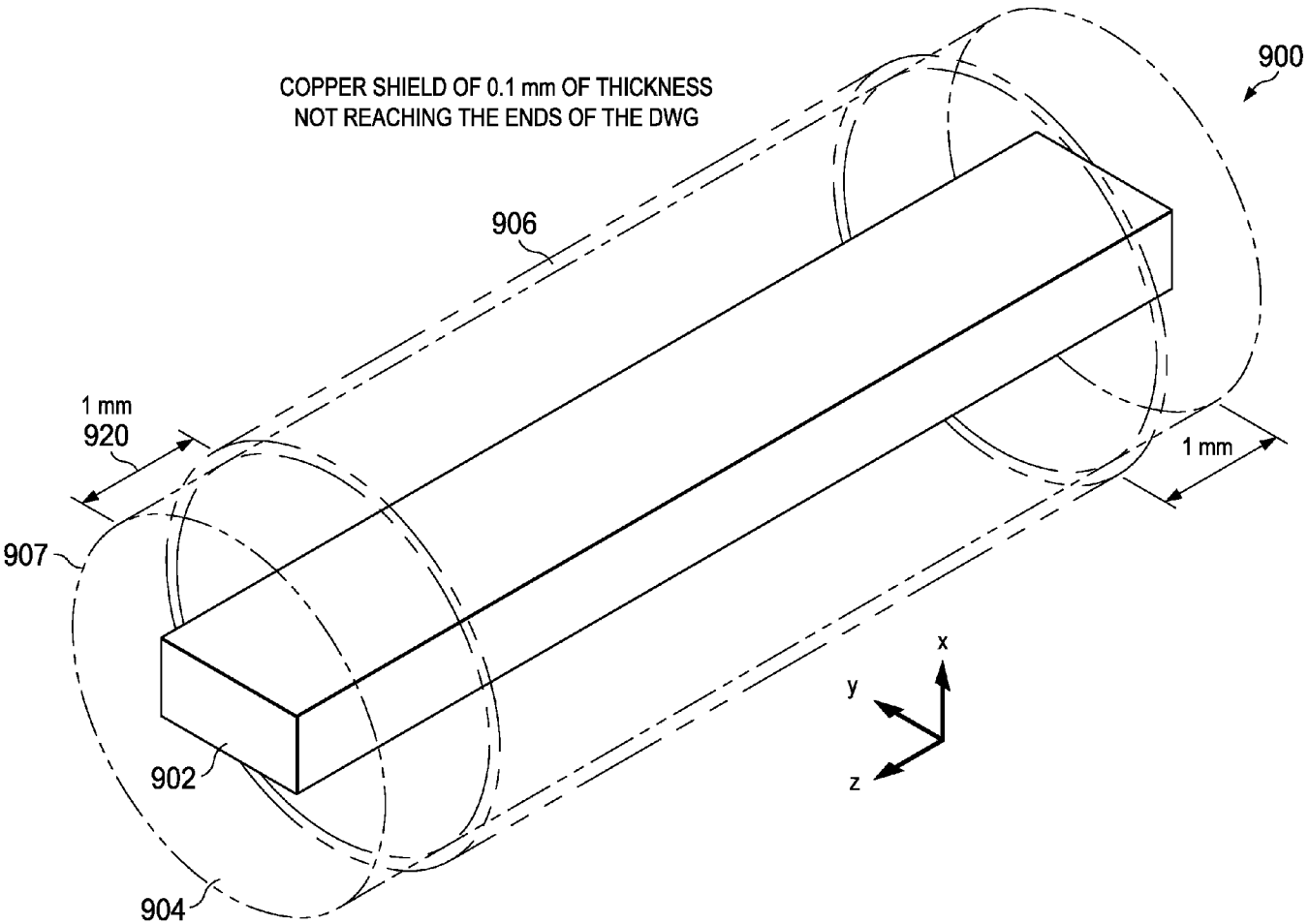
FIGS. 9 and 10 illustrate a shielded DWG in which the shield does not extend to the ends of the DWG.

FIG. 9 illustrates a shielded DWG 900 in the X, Y and Z directions in which the shield does not extend to the ends of the DWG. In this example, shield 906 stops short of the end 907 of cladding 904 by about 1 mm. While not illustrated, core 902 may be terminated at this point by a connector or other coupling mechanism. Several types of coupling mechanisms are described in more detail in U.S. Pat. No. 9,373,878 and need not be described in further detail herein. In this manner, shield 906 may be totally isolated from the connector and not conductively connected to any voltage reference. This is not a problem, however, since shield 906 only needs to attenuate any evanescent field on the surface of DWG 900 and does not need to be referenced to any voltage source to perform this function.

Figure 10:
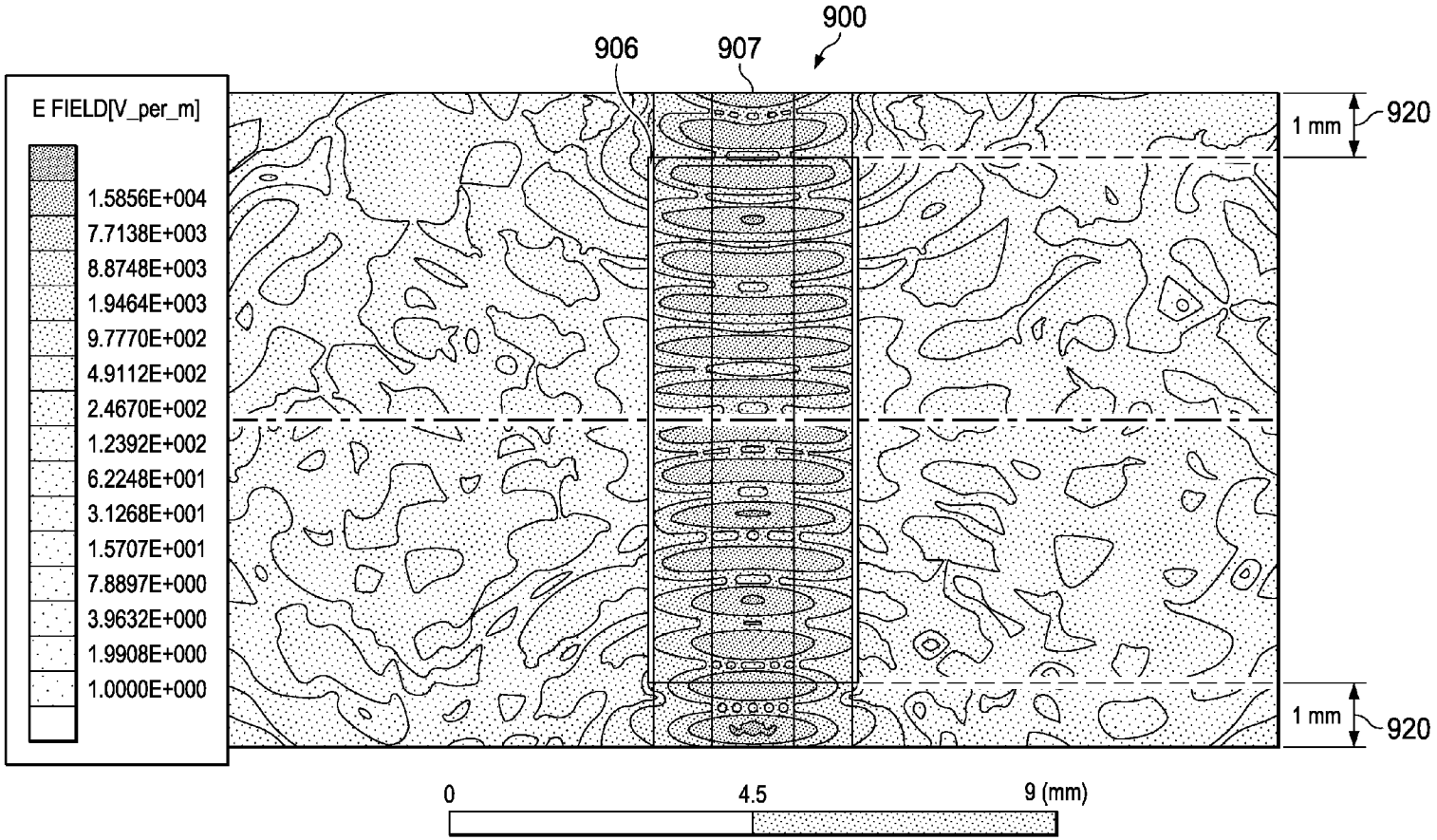

FIG. 10 is a simulation of a signal travelling along DWG 900 with a length scale of from 0 to 9 mm. A field intensity scale presents values for E Field [V per m]. Notice that there is a minimal amount of field strength breakout in gap region 920; however, it is not enough to cause any significant coupling to an external object such as a finger or hand, for example.

Figure 11:
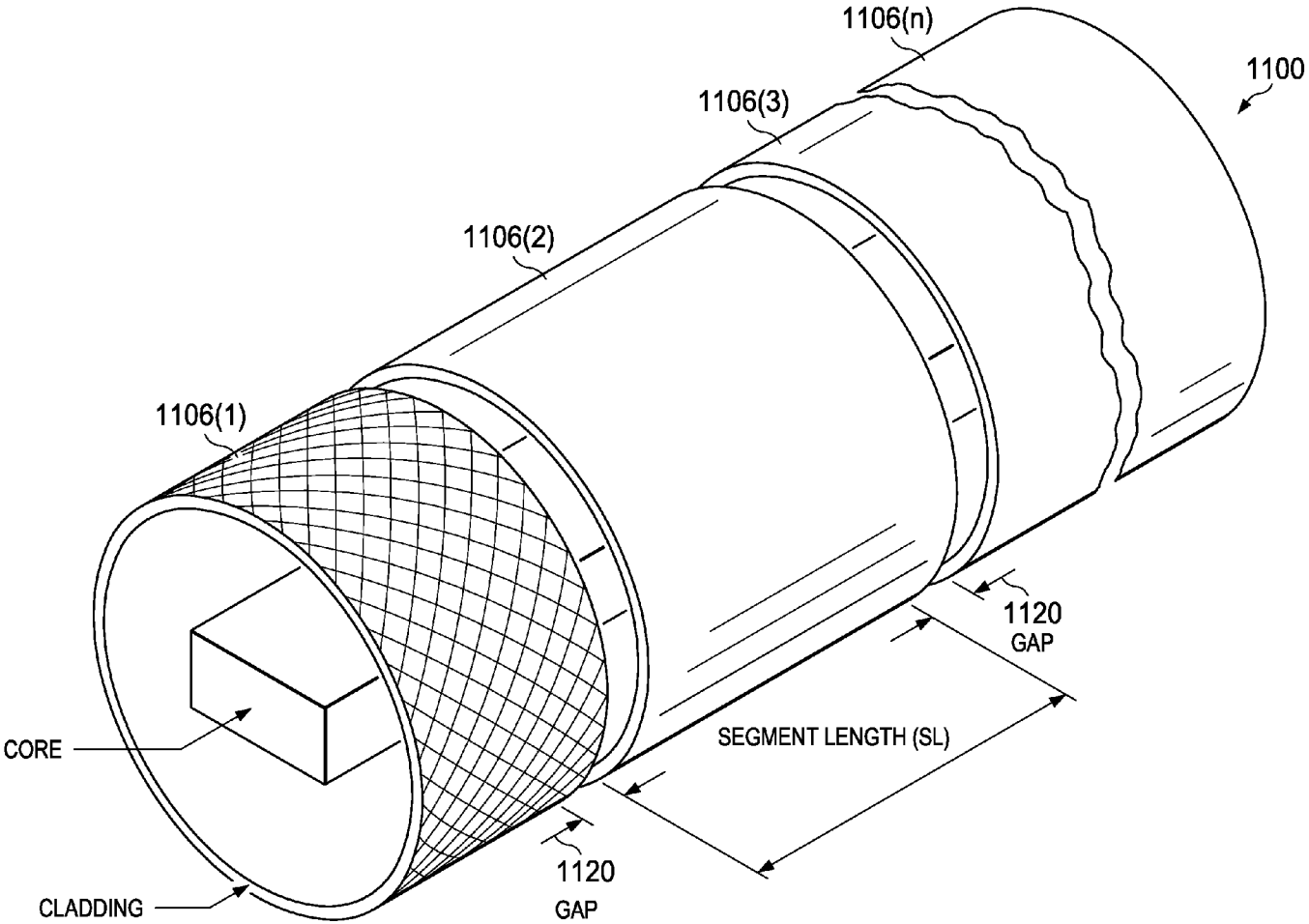
FIG. 11 is an illustration of various configurations of shielding for a DWG.

FIG. 11 is an illustration of various configurations of shielding for a DWG 1100. The shield layer may include multiple segments 1106(1), 1106(2), 1106(3), . . . (1106(*n*) of separate cylindrical shaped rings that are spaced apart by a gap distance 1120 that is less than approximately one wavelength of a target signal. Referring back to FIG. 1, the wavelength of a signal in the frequency range of 100-200 GHz in a cladding material having a dielectric constant value of three is about 1.0-1.8 mm, as illustrated by plot 102. Thus, as long as gap distance 1120 is less than approximately 1 mm very little field strength will escape the shield perimeter. The segment length (SL) of each segment may be as small as is economical to manufacture, for example. Similarly, the shield may be made from a mesh, as long as the openings in the mesh are less than approximately one wavelength of a target signal.

As discussed earlier, the shield layer may be a foil made of aluminum, copper or any good conductivity material. The shield may be formed from a metal, a metalloid, or a conductive non-metal such as graphite or graphene, for example. This layer may be made using conductive paint or by various types of evaporation or sputtering methods, for example. The thickness of this conductive layer should to be thicker than the skin depth thickness of the material used in the frequency range of interest. For example, at 140 GHz the skin depth of metals with high conductivity (Cu, Al, and Au etc) is less than 1 um; thus essentially any metal layer may serve as a good shield.

Figure 12:
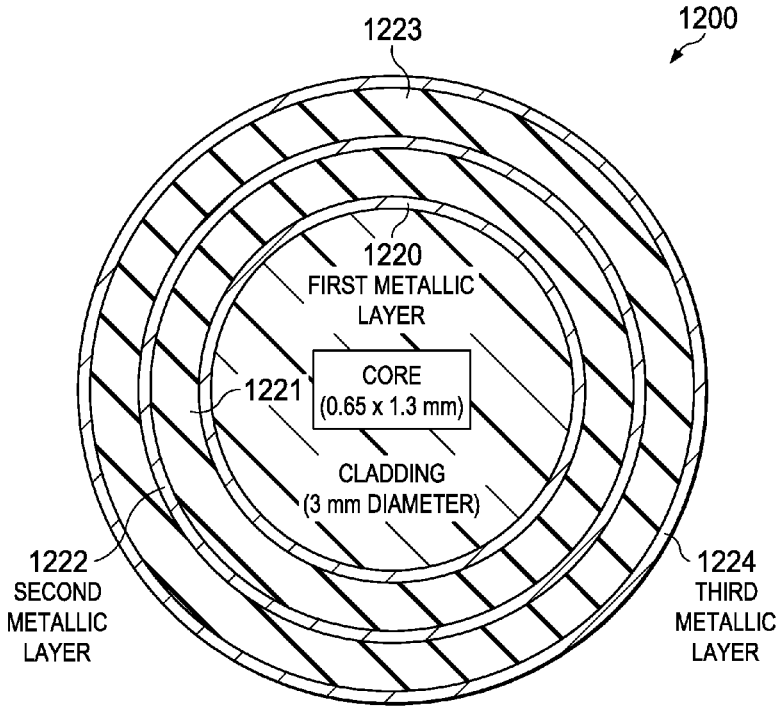
FIG. 12 is an illustration of a DWG with multiple conductive layers around the core.

FIG. 12 is an illustration of a DWG 1200 with multiple conductive layers around the core. There are many cases where a flexible DWG alone is not sufficient for an interface between two components. For example, the DWG by nature is an insulator. While it can efficiently guide high frequency RF signals, delivering appreciable levels of power is not possible. It may be desirable in many cases to provide either a DC or low frequency traditional conductive wire solution in combination with a high frequency communication path afforded by one or more flexible DWGs.

In this example, there is a first conductive layer 1220, an insulating layer 1221, a second conductive layer 1222, a second insulating layer 1223, and a third conductive layer 1224. Additional insulating and conductive layers may be provided. If the conductive layers are continuous along the length of DWG 1200, then each conductive layer may be used to conduct a DC current or low frequency signal.

In another example, it may be desirable to include a DWG within an existing type of cabling system. For example, USB is a commonplace interconnect that provides data at 12 MBps (USB1.1), 480 Mbps (USB2.0) and 5.0 Gbps (USB3.0) using high speed conductive cabling and in addition provides power from a host device to a peripheral device. Inclusion of a DWG in a USB cable would allow the same cable to be used for MBps (megabit per second) and for sub-terahertz data communication. Another example is the common power cord connecting a PC (laptop, pad, tablet, phone, etc) to a power source. This can either be the AC lines in the case of a PC or to a DC power supply. Inclusion of a DWG with the power cable may allow using the power cable to supply power and also to provide high speed data transfer to a network connection that is included with the power system of a building, for example.

Figure 13:
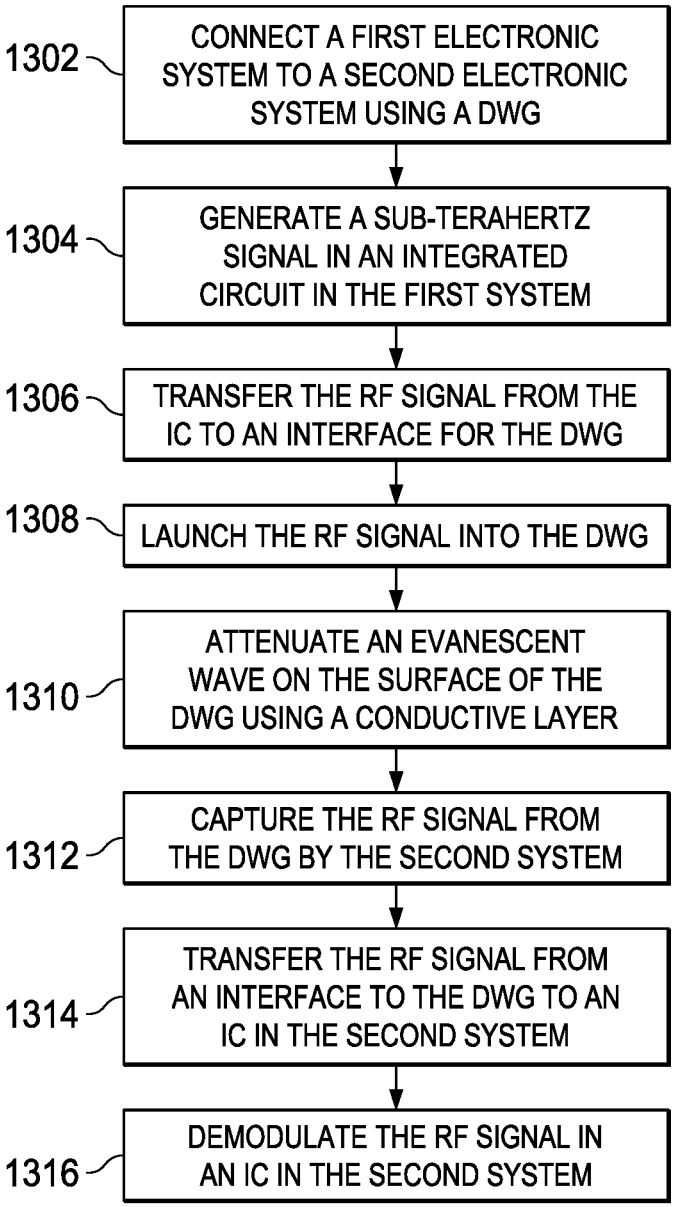
FIG. 13 is a flow chart illustrating use of a DWG in a system.

FIG. 13 is a flow chart illustrating use of a dielectric waveguide in a system. A system integrator or a system user may connect at 1302 a first electronic system to a second electronic system using a DWG. The two systems may be simply two different ICs that may be part of larger system, for example, that is being assembled by a system integrator. The two systems may be a computing device and a peripheral device or two computing devices that a user is connecting together for personal or business use, for example. The systems may be any form of computing device, such as, but not limited to: a rack mount, desk mount, or portable computer, a mobile user device such a notebook computer, a tablet computer, a smart phone, etc, for example. The systems may be any type of peripheral device such as: a media storage device such as rotating or solid state disk drive, a modem or other interface to a high speed network, etc, for example.

The DWG may be any form of flexible of rigid DWG as described in more detail above, for example. The DWG may be a combination cable as described above, such as an enhanced USB cable that includes a DWG, for example. The connection may use an RJ45 connector, as described in more detail above. There may be a single DWG, or there may be multiple DWGs, depending on the requirements of the systems.

Once the system are connected and turned on, a sub-terahertz RF signal may be generated at 1304 by an IC in the first system. A stream or multiple streams of data may be modulated onto the RF signal using known modulation techniques. The RF signal is then transferred at 1306 from the IC and launched at 1308 into the DWG using various coupling techniques, such as described in U.S. Pat. No. 9,373,878, for example.

As described in more detail above, an evanescent wave traveling on a surface of the DWG may be attenuated at 1310 with a conductive layer around an outer surface of the dielectric cladding.

The second system may then capture at 1312 the radiated RF signal from the DWG and transfer at 1314 the captured RF signal using any of the coupling techniques mentioned herein. An IC within the second system may then demodulate at 1316 the RF signal to recover the one or more streams of data for use within the second system.

Two DWGs may be used for bidirectional transfer of data, or a single DWG may be used by providing transceivers in each of the two systems, for example.

As shown by the above descriptions and examples, two or more electronic devices may be easily interconnected to provide sub-terahertz communication paths between the electronic devices by using the techniques described herein. The shape of the internal core sets the propagating mode, while the shape and cross section of outer cladding and thin conductive shield may have various shapes. The conductive shield needs to be conductive around the complete circumference of the DWG, but does not need to be conductive in the longitudinal direction of cable. This allows the shield to have small spaces between multiple shield segments and allows for connectors that isolate the conductive shield and hence can allow for a wide range of designs for a DWG. The conductive shield also allows for other wires to be brought close to DWG without interference.

As can be seen from the examples described herein, a DWG operates in a significantly different manner than the traditional metallic waveguide. in a DWG, the signal is transmitted through the core and the dielectric cladding provides isolation via the exponential decline of the electric field strength. However, as described herein a conductive shield may be used to provide additional isolation. In the case of the standard metallic waveguides, the dimensions of the metallic structure determines the transmission modes and it is a critical part of the waveguide. In the DWG case, the geometry and dimensions of the dielectric core determine the transmission modes and are the critical piece of the interconnect. The conductive shield on a DWG is just an accessory to reduce the evanescent field. From the electromagnetic field's point of view, it is important that the DWG still behaves as DWG even with an external metallic foil shield. This indicates that the characteristics of the transmission is mainly determined by the dielectric core and dielectric cladding and not by the dimensions and geometry of the external metal shield.

The DWG concept does not rely on metallic conduction to propagate the signal like a coaxial cable or a metallic waveguide but instead relies mostly on the dielectric polymers to propagate the signal.

OTHER EMBODIMENTS

While the invention has been described with reference to illustrative embodiments, this description is not intended to be construed in a limiting sense. Various other embodiments of the invention will be apparent to persons skilled in the art upon reference to this description. For example, while a single core was illustrated in the examples described herein, multiple cores may be combined into a single DWG assembly and then shielded by a single conductive shield layer, as described herein.

Embodiments of a DWG may be fabricated using flexible materials for the core and cladding, as described herein, or may be fabricated using rigid materials such as hard plastic, fiberglass structures, etc., for example.

In some embodiments, a conductive shield may be provided on a portion of the length of a DWG, and not be present on another portion of the DWG. For example, a portion of a DWG that is otherwise protected from being touched or handled may not need to have a conductive shield.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A dielectric waveguide (DWG) comprising:

a dielectric core member having a length L and an oblong cross section shape, the core member having a first dielectric constant value;

a dielectric cladding surrounding the core member, the cladding having a second dielectric constant value that is lower than the first dielectric constant value; and a first conductive layer formed of separate, cylindrical shaped rings surrounding the cladding, the rings being spaced apart by a distance that is less than approximately one wavelength of a target signal.

2. The DWG of claim 1 in which the target signal has a frequency in a range of 100-200 GHz, the cladding material has a dielectric constant value of three, and the spacing between rings is less than approximately 1 mm.

3. The DWG of claim 1, wherein the DWG is comprised within an electronic system, wherein the system further comprises: a first component coupled to a first end of the DWG; and a second component coupled to an opposite end of the DWG.

4. The DWG of claim 1 in which the core member has a rectangular cross section shape and the cladding has a round cross section shape.

5. The DWG of claim 1 in which the cladding has a cross section shape different from the cross section shape of the core member.

6. The DWG of claim 1 in which the first conductive layer includes a sputtered coating.

7. The DWG of claim 1 in which the first conductive layer includes an evaporated layer of conductive material.

8. The DWG of claim 1 in which the first conductive layer includes a conductive paint.

9. The DWG of claim 1 in which the first conductive layer includes a metallic foil.

10. The DWG of claim 1 in which the core member is made of high density polyethylene and the cladding is made of polypropylene.

11. The DWG of claim 1, further comprising a connector attached to an end of the DWG, wherein the conductive layer is conductively isolated from the connector.

12. The DWG of claim 1 in which the conductive layer has a thickness of less than 1 μm.

13. The DWG of claim 1, wherein the oblong cross section of the dielectric core member has an aspect ratio of approximately 1:2.

14. The DWG of claim 1 including a connector on each end of the DWG.

* * * * *